US006511312B2

(12) United States Patent
Primdahl

(10) Patent No.: US 6,511,312 B2
(45) Date of Patent: Jan. 28, 2003

(54) SWIRLER BURNER

(75) Inventor: Ivar Ivarsen Primdahl, Copenhagen (DK)

(73) Assignee: Haldor Topsoe A/S, Lyngby (DK)

( * ) Notice: Subject to any disclaimer, the term of this patent is extended or adjusted under 35 U.S.C. 154(b) by 0 days.

(21) Appl. No.: 10/035,048

(22) Filed: Jan. 3, 2002

(65) Prior Publication Data

US 2002/0086257 A1 Jul. 4, 2002

(30) Foreign Application Priority Data

Jan. 4, 2001 (DK) ..... 2001 00010

(51) Int. Cl.[7] ..... F23C 7/00; F23C 9/00

(52) U.S. Cl. ..... 431/187; 431/19; 431/181; 239/403; 239/416.5; 239/424

(58) Field of Search ..... 431/181, 187, 431/9, 7, 190; 239/403, 416.5, 404, 406, 402, 424

(56) References Cited

U.S. PATENT DOCUMENTS 5,251,447 A * 10/1993 Joshi et al. ..... 431/185
5,351,477 A * 10/1994 Joshi et al. ..... 239/403
5,496,170 A 3/1996 Primdahl et al.
5,758,587 A * 6/1998 Buchner et al. ..... 431/181

* cited by examiner

*Primary Examiner*—James C. Yeung
(74) *Attorney, Agent, or Firm*—Dickstein Shapiro Morin & Oshinsky, LLP

(57) ABSTRACT

Swirling-flow burner with a burner tube comprising a central oxidiser supply tube and an outer concentric fuel supply tube, the oxidiser supply tube being provided with a concentric cylindrical guide body having static swirler blades and a central concentric cylindrical bore, the swirler blades extending from outer surface of the guide body to inner surface of oxidiser supply tube being concentrically arranged within space between the guide body and inner wall at lower portion of the oxidiser supply tube.

7 Claims, 2 Drawing Sheets

SWIRLER BURNER

BACKGROUND OF THE INVENTION

1. Field of the Invention

The present invention is directed to combustion of hydrocarbon fuel and in particular to a burner with a swirler body for use in hydrocarbon fueled combustion reactors.

2. Brief Description of the Related Art

Burners with a swirling flow of a combustion reactant are mainly used for firing gas-fueled industrial furnaces and process heaters, which require a stable flame with high combustion intensities. Conventionally designed swirling flow burners include a burner tube with a central tube for fuel supply surrounded by an oxidizer supply port. Intensive mixing of fuel and oxidizer in a combustion zone is achieved by passing the oxidizer through a swirler installed at the burner face on the central tube. The stream of oxidizer is, thereby, given a swirling-flow, which provides a high degree of internal and external recirculation of combustion products and thus a high combustion intensity.

As a general drawback of conventional swirling-flow burners of the above design, the burner face experiences high gas flow velocities, as required for industrial burners of this design, and is exposed to overheating caused by the high degree of internal recirculation along the central axis of the combustion zone. Hot combustion products flow, thereby, back towards the burner face, which results in rapid heating, up to high temperatures and, consequently, destruction of the face.

A swirling burner for use in small and medium scale applications with substantially reduced internal recirculation of combustion products toward the burner face is disclosed in U.S. Pat. No. 5,496,170. The burner design disclosed in this patent results in a stable flame with high combustion intensity and without detrimental internal recirculation of hot combustion products by providing the burner with a swirling-flow of oxidizer having an overall flow direction concentrated along the axis of the combustion zone and at the same time directing the fuel gas flow towards the same axis.

The disclosed swirling-flow burner comprises a burner tube and a central oxidizer supply tube concentric with and spaced from the burner tube, thereby defining an annular fuel gas channel between the tubes, the oxidizer supply tube and the fuel gas channel having separate inlet ends and separate outlet ends. U-shaped oxidizer and fuel gas injectors are arranged coaxially at the burner face. The burner is further equipped with a bluff body with static swirler blades extending inside the oxidizer injector. The swirler blades are mounted on the bluff body between their upstream end and their downstream end and extend to the surface of the oxidizer injection chamber.

In burners for large-scale reactors, the swirler blades will have an extended length and area, which decreases the mechanical stability of the blades. Alternatively, the bluff body has to be constructed with a larger size to reduce the length of the swirler blades.

Disadvantageously, the swirler blades in a large-scale swirler burner have a size, which causes mechanical stability problems and unintended vibrations. Alternatively, when upscaling the swirler bluff body, the pressure drop of oxidizer flowing around the body will disadvantageously increase. Widening the outlet end of the fuel and/or oxidizer supply tube may compensate for the increasing pressure drop. However, the desired flow pattern around the axis of the combustion zone will then be disadvantageously scattered around the axis.

Thus, the main object of the invention is to obtain a swirler body, preferably for use in large-scale swirler burners with a bluff body and swirler blades having a size and shape without the above problems in large-scale swirler burners.

SUMMARY OF THE INVENTION

Accordingly, this invention is a swirling-flow burner including a burner tube with an outer fuel supply tube and a central oxidizer supply tube concentric with the fuel supply tube. According to an alternative embodiment the swirling-flow burner with a burner tube includes a central oxidizer supply tube and an outer concentric fuel supply tube, the oxidizer supply tube being provided with a concentric cylindrical guide body having static swirler blades and a central concentric cylindrical bore, the swirler blades extending from the outer surface of the guide body to the inner surface of the oxidizer supply tube, being concentrically arranged within a space between the guide body and inner wall at a lower portion of the oxidizer supply tube.

In a further embodiment, the burner also includes the swirling-flow burner central borestatic swirler blades and a central bluff body, the static swirler blades extending from surface of the bluff body to a surface of the guide body.

Additional stabilization of the swirler blades during operation is obtained by fixing the outer swirler blades in the above burner on the inner surface of the oxidizer supply tube. The guide body is then mounted on an outer edge of the inner swirler blades.

The inner swirler blades are preferably formed by machining the outer surface of the bluff body.

The swirling-flow induced in the swirler promotes mixing of fuel gas and oxidizer by increasing the area of their contact. Effective mixing is obtained when adjusting the pitch angle of the swirler blades to an angle of between 15° and 75°, preferably between 20° and 45°.

An increased mixing of fuel gas and oxidizer is additionally provided, when arranging the inner swirler blades around a central part of the bluff body and an upper portion of the guide body, and the outer swirler blades around a lower portion of the bluff body and a lower portion of the guide body.

An inwardly directed flow pattern of combustion reactants along an axis of a combustion zone adjacent to the burner face is obtained by U-shaped contours of outlet ends of the fuel, and oxidizer supply tubes, and prevents recirculation of hot combustion products in a high temperature region around axis of the combustion zone, which otherwise leads to overheating and destruction of the burner face.

The inwardly directed flow pattern leads to a high degree of external recirculation in a low temperature outer region of the combustion zone. From this region only cooled combustion products flow back to the burner face, where the products are being sucked into the hot combustion zone area and reheated there.

To maintain substantially the above flow pattern it is additionally preferred that a contour of the guide body follows the contour of the inner wall of the oxidizer supply tube.

When operating a burner according to the invention in gas fired reactors, the recycle stream of cooled combustion products protects advantageously the reactor walls surrounding the combustion zone against impingement of hot combustion products and prolongs the lifetime of the reactor. The temperature at the burner face close to the outlet end of the injection chambers may further be lowered by forming the oxidizer tube at the outlet end sharp-edged with a minimum tip angle. Reduced heating and suitable mechanical strength of the injector are obtained at tip angles of between 15° and 60°, preferably between 15° and 40°.

As a further advantage of the burner according to the invention, the high degree of external recirculation of cooled combustion products provides a homogeneous temperature distribution in the combustion outlet zone.

This is of great importance during operation of fired catalytic reactors, where the product yield highly depends on the temperature distribution in the catalyst bed, which typically is arranged in the combustion outlet zone.

In another embodiment of the invention the guide body is solid and provided with a bore in the middle, concentric with the axis of the burner. This ensures the swirling effect as above with the same radius of outer swirler blades, and simultaneously low pressure drop when operating with high oxidizer gas flows. The hot reaction zone is forced away from the burner tip, still maintaining the rotation of the reacting gas around the axis of the burner.

Accordingly, the burner of this invention is particularly useful in largescale gas-fueled reactors with heating and catalytic processes without creating additional pressure drop or mechanical instability.

The above objects and advantages of the invention are explained in more detail in the following description by reference to the drawings, in which the figures show a cross sectional view of the lower portion of a fuel and oxidizer supply tube in a swirling flow burner according to two specific embodiments of the invention.

DETAILED DESCRIPTION OF THE PREFERRED EMBODIMENTS.

Figure 1:
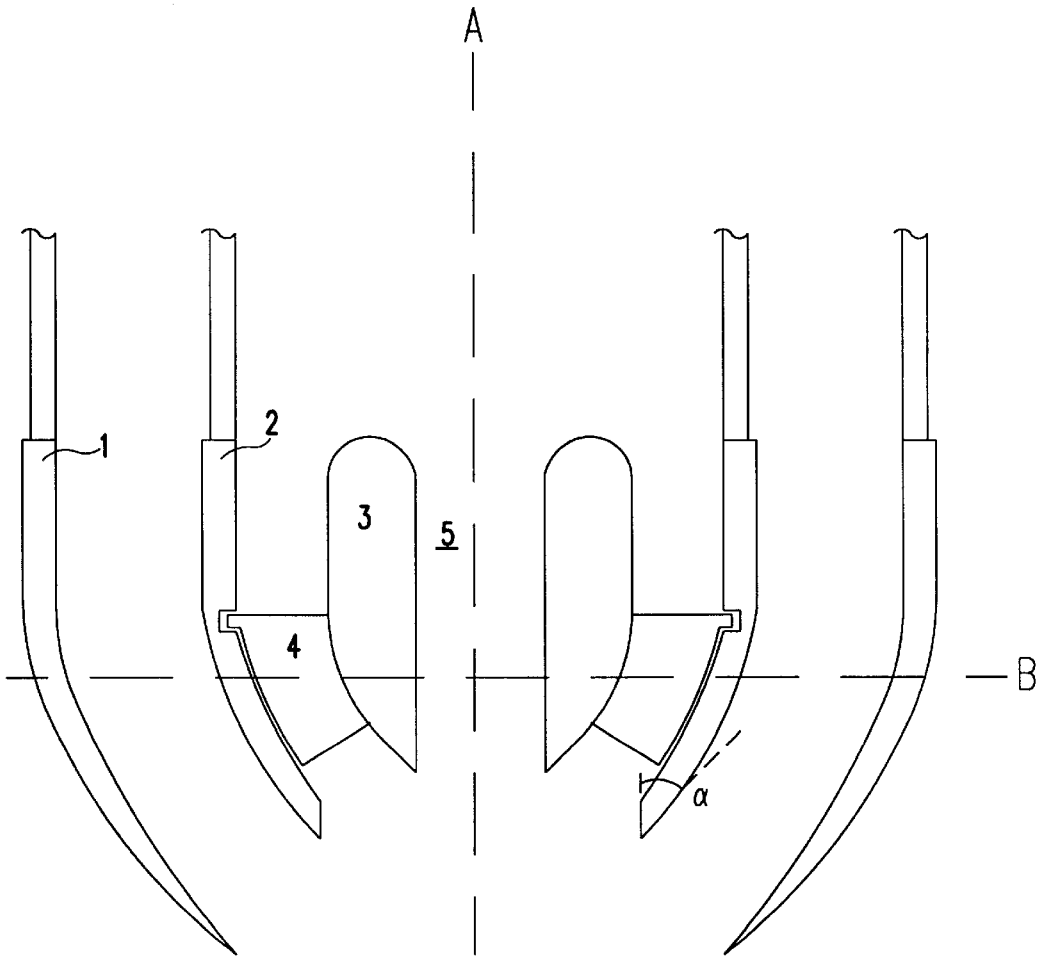
FIG. 1 illustrates a swirler burner according to a preferred embodiment of the present invention.

FIG. 1 shows one embodiment of the invention. The fuel supply tube 1 of the burner concentrically surrounds the oxidizer supply tube 2 which comprises the guide body 3 provided with swirler blades 4. Swirler blades 4 are arranged in a plane B around the lower part of the guide body. Guide body 3 is provided with a bore 5 for oxidizer supply concentrically arranged in the burner.

Figure 2:
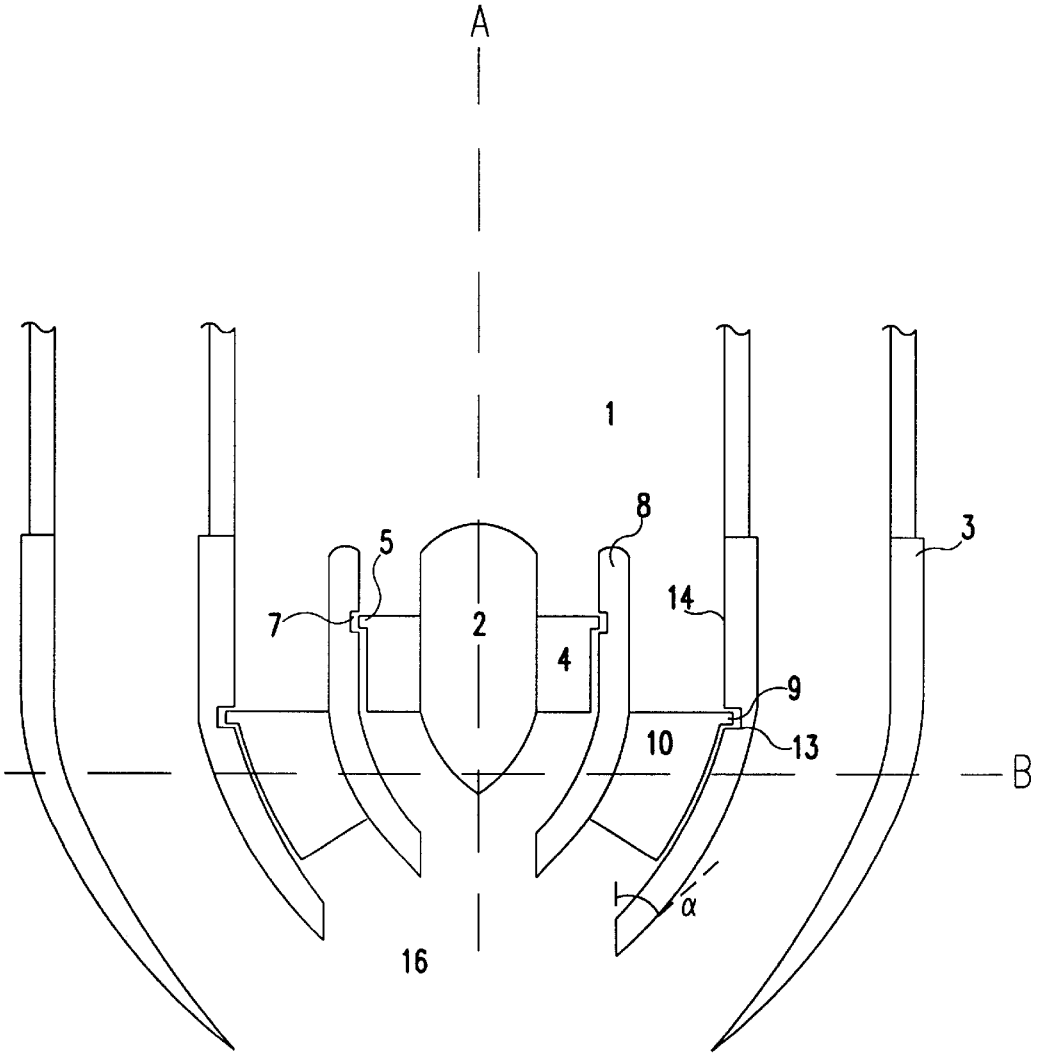
FIG. 2 illustrates a swirler burner according to an alternative embodiment of the present invention.

Referring to FIG. 2, a lower portion of oxidizer supply tube 1 is provided with a central bluff body 2 surrounded by a fuel supply tube 3. Inner swirler blades 4 and outer swirler blades 10 also are provided. Bluff body 2 is provided with a dome-shaped upstream end and a tapered downstream end. Swirler blades 4 are an integrated part of bluff body 2 obtained by machining the surface of body 2. Blades 4 extend from an outer surface of body 2 to a guide body 8 is arranged coaxially in tube 1 between bluff body 2 and wall 14 of tube 1. Blades 4 are arranged within tube 1 around an axis A between an upper portion of body 2 and an upper portion of guide body 8. Blades 4 are fixed with suitable tolerance for thermal expansion into guide body 8 by means of slots 7 and tongues 5 provided in the guide body and on the blades, respectively.

Outer swirler blades 10 are arranged in the oxidizer supply tube in a space between guide body 8 and wall 14 around axis A and with the centers of gravity in a plane B, perpendicular on axis A and going through a lower portion of bluff body 2 and wall 14.

Similar to the inner blades, outer swirler blades 10 are fixed with tolerance to oxidizer tube wall 14 by tongues 9 on the blades resting in slots 13 formed in wall 14. Blades 10 are further mounted on the surface of guide body 8. Alternatively, blades 10 may be formed as an integrated part of the guide body.

At outlet end 16 of tube 1, wall 14 and guide body 8 have a U-shaped cross sectional inner surface around axis A.

The U-shaped form may conveniently be obtained by machining a suitable metallic body having a cylindrical part and a conical part. The transition angle between the cylindrical and conical part is thereby preferably in the range of 115° and 170°.

The edge of wall 14 surrounding outlet end 16 is tapered with a minimum tip angle $\gamma$ in order to protect the edge against overheating as described more detailed below.

The tip angle is typically 15°–60°, preferably 15°–40°.

When operating the burner according to the invention, an oxidizer stream is brought into swirling-flow by passage through swirler blades 4 and 10. Furthermore, by means of bluff body 2 and the U-shaped contour of outlet ends of guide body 8, oxidizer tube 1 and fuel tube 3, the swirling oxidizer stream is discharged into a combustion zone in an overall flow directed around the axis of the combustion zone.

As a result, mixing of the oxidizer and fuel gas stream is mainly accomplished in the high temperature region around the axis of combustion zone. Thereby, deleterious internal recirculation of hot combustion products within this region is prevented. Recirculation is only established in the low temperature outer region of the combustion zone, resulting in reduced material temperatures close to the outlet ends of the injection chambers. As mentioned hereinbefore, the temperature in this region may further be controlled by angle y of the oxidizer injector edge around the outlet end of the oxidizer injection chamber, whereby the mixing zone of oxidizer and fuel gas is kept at an increasing distance from the edge at decreasing tip angles.

In applications requiring very high combustion intensities the burner face may further be protected against high temperatures by addition of an inert gas or steam in the region of the outlet end.

What is claimed is:

1. Swirling-flow burner with a burner tube comprising a central oxidizer supply tube and an outer concentric fuel supply tube, the oxidizer supply tube and the fuel gas supply tube having separate inlet ends and separate outlet ends, the oxidizer supply tube being provided with a concentric cylindrical guide body located adjacent the outlet ends of the supply tubes and having static swirler blades and a central concentric cylindrical bore, the swirler blades extending from an outer surface of the guide body to an inner surface of the oxidizer supply tube, the swirler blades being concentrically arranged within a space between the guide body and an inner wall at a lower portion of the oxidizer supply tube, and positioned adjacent a lower portion of the guide body.

2. The swirling-flow burner of claim 1, wherein the swirler blades are arranged with a pitch angle of 15°–75°.

3. The swirling-flow burner of claim 1, wherein the central oxidizer supply tube and the outer fuel supply tube have a tip angle of 15°–60° at the outlet end.

4. The swirling-flow burner of claim 1, further comprising static swirler blades and a central bluff body in the central bore, the static swirler blades extending from the surface of the bluff body to the outer surface of the guide body.

5. Use of a burner according to anyone of the preceding claims for carrying out catalytic processes in a gas fuelled reactor.

6. The swirling-flow burner of claim 2, wherein the swirler blades are arranged with a pitch angle of 20°–45°.

7. The swirling-flow burner of claim 3, wherein the central oxidizer supply tube and the outer fuel supply tube have a tip angle of 15°–40° at the outlet end.

* * * * *